United States Patent [19]

Hall, Jr.

[11] 4,393,580

[45] Jul. 19, 1983

[54] ONE STEP APPLICATOR TOOL

[75] Inventor: Leslie C. Hall, Jr., Camp Hill, Pa.

[73] Assignee: AMP Incorporated, Harrisburg, Pa.

[21] Appl. No.: 231,714

[22] Filed: Feb. 5, 1981

[51] Int. Cl.[3] ..... H01R 43/04

[52] U.S. Cl. ..... 29/749; 29/753; 29/760

[58] Field of Search ..... 29/749–754, 29/760

[56] References Cited

U.S. PATENT DOCUMENTS

| | | | |
|---|---|---|---|
| 3,820,055 | 6/1974 | Huffnagle et al. | 339/17 F |
| 4,020,540 | 5/1977 | Casciotti et al. | 29/749 |
| 4,077,695 | 3/1978 | Bakermans | 29/749 X |
| 4,209,219 | 6/1980 | Proietto | 339/99 R |
| 4,351,110 | 9/1982 | Folk | 29/749 |

*Primary Examiner*—Carl E. Hall

*Attorney, Agent, or Firm*—Russell J. Egan

[57] ABSTRACT

An applicator tool is disclosed for applying multiple terminal electrical connectors to flat cables, formed by a plurality of closely spaced parallel conductors, in a single application step. The tool is a bench mounted applicator which is adjustable to accommodate preformed multi-conductor flat cables of conventional dimensions and which also will allow sequential application of connectors to form a daisy chain cable. The applicator tool includes means to positively clamp the multi-conductor flat cable so as to be properly and accurately aligned with the tooling assembly, which applies the connector to the cable, and to ensure that the cable will stay in place during the application step. The tooling assembly is adaptable to accommodate a wide range of terminal configurations and connector sizes. While the actuation means for the tool has been shown as being manual, it likewise can be powered by any known means, such as a fluid drive.

5 Claims, 6 Drawing Figures

ONE STEP APPLICATOR TOOL

BACKGROUND OF THE INVENTION

1. Field of the Invention

The present invention relates to an applicator tool for applying multi-terminal electrical connectors to multi-conductor flat electrical cable and in particular to an applicator which will apply connectors having a plurality of closely spaced insulation piercing terminals onto flat cable having a like plurality of closely spaced insulated conductors.

2. Prior Art

The present invention is intended for use in applying connectors of the type disclosed in U.S. Pat. No. 3,820,055 onto multi-conductor flat cables. Heretofore, connectors of this type have been applied in the manner shown in FIG. 7 of the noted patent. However, these previous techniques for applying connectors have had certain drawbacks in that they were rather slow in first applying the connector and then the cover. They were also open to error in placement of the cable and they could not be readily shifted to accommodate various width cables and sizes of connectors.

A subsequent development was the applicator tool shown in U.S. Pat. No. 4,020,540. This tool solved many of the problems inherent in the method disclosed in the first mentioned patent, but still required a two-step assembly. The subject tool was intended for use with the improved version of the above noted electrical connector as described in U.S. patent application No. 555,655 filed July 9, 1979, now abandoned in favor of application Ser. No. 6/200,743 filed Oct. 27, 1980 now U.S. Pat. No. 4,359,257.

SUMMARY OF THE INVENTION

The present invention relates to a bench mounted frame assembly supporting applicator tooling assembly which acts in cooperation with a slide base mounted assembly to effect one step termination of multi-conductor flat cable. The frame assembly includes a generally C-shape frame having a tool driving ram and ram actuating means on the upper portion of the frame and tooling assembly guide rails on the lower portion of the frame. The tooling assembly includes a base plate assembly having a sliding base mounted on the guide rails with a fluted base plate mounted on the sliding base and provided with adjustable and stationary spaced parallel guide means, cable end stop means, and clamping means adopted to secure the cable to the fluted base plate. The clamping means may also be fluted to assist in cable registration while obviating the need for fixed and adjustable guide means. The clamping means includes a pair of parallel spaced spring loaded clamping members which together serve to secure the cable in position.

It is therefore an object of the present invention to produce an electrical connector applicator tool having means to positively position multi-conductor cable for accurate application of a multi-contact connector to the cable, at an end of the cable or at any point intermediate the ends of the cable.

It is another object of the present invention to produce an electrical connector applicator tool which can be adjusted to accept a wide range of dimensions of flat multi-conductor cable as well as a wide range of connector sizes and terminal configurations.

It is still another object of the present invention to produce an electrical connector applicator tool which can be used to apply electrical connectors to multi-conductor flat cables by operators having only minimal amounts of skill and training.

It is yet another object of the present invention to produce an electrical connector applicator tool which can be readily and economically produced.

The means for accomplishing the foregoing objects and other advantages of the present invention will become apparent from the following detailed description taken with reference to the accompanying drawings.

DETAILED DESCRIPTION OF THE PREFERRED EMBODIMENT

Figure 1:
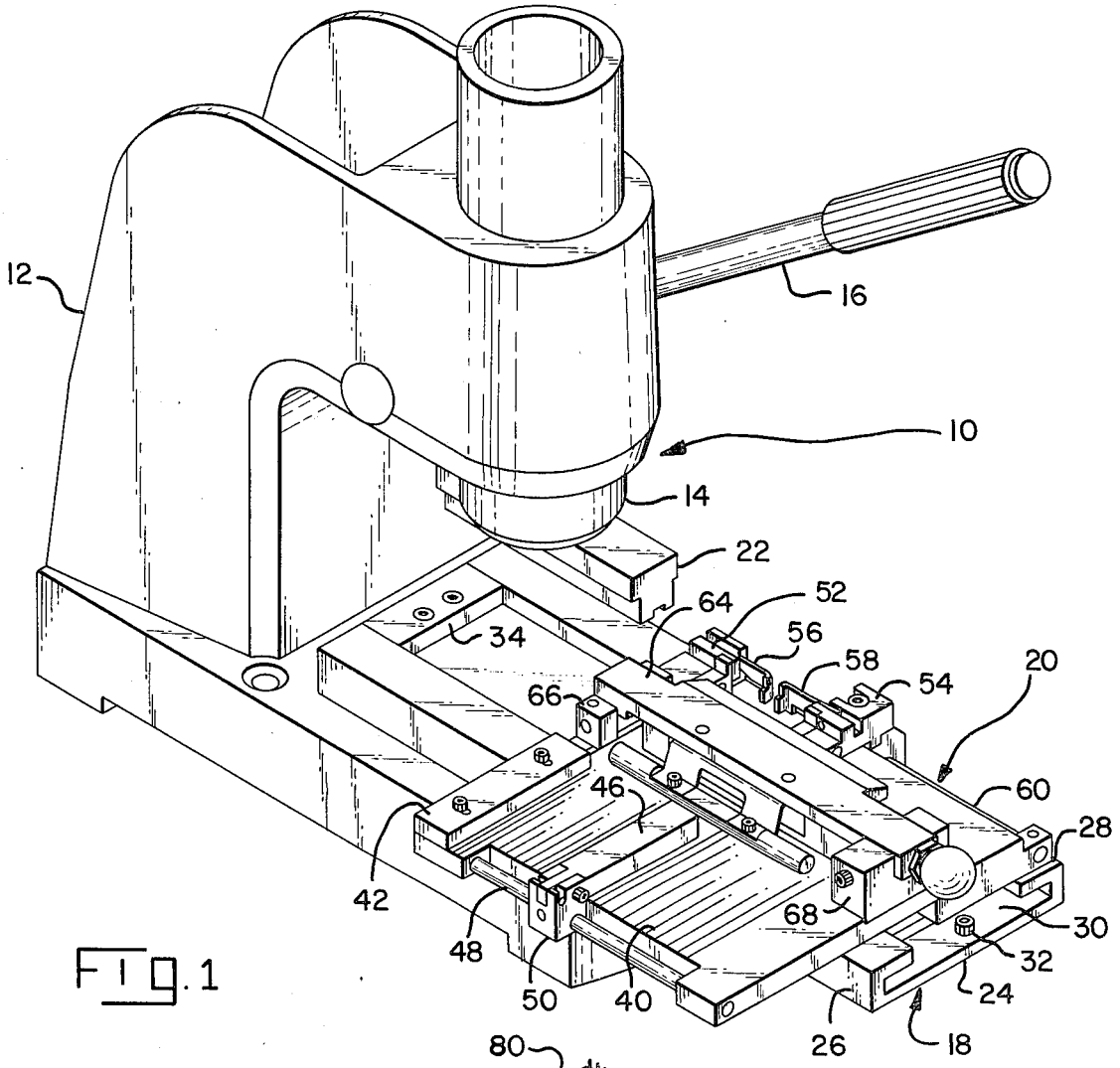
FIG. 1 is a perspective view of the subject applicator tool.
Figure 5:
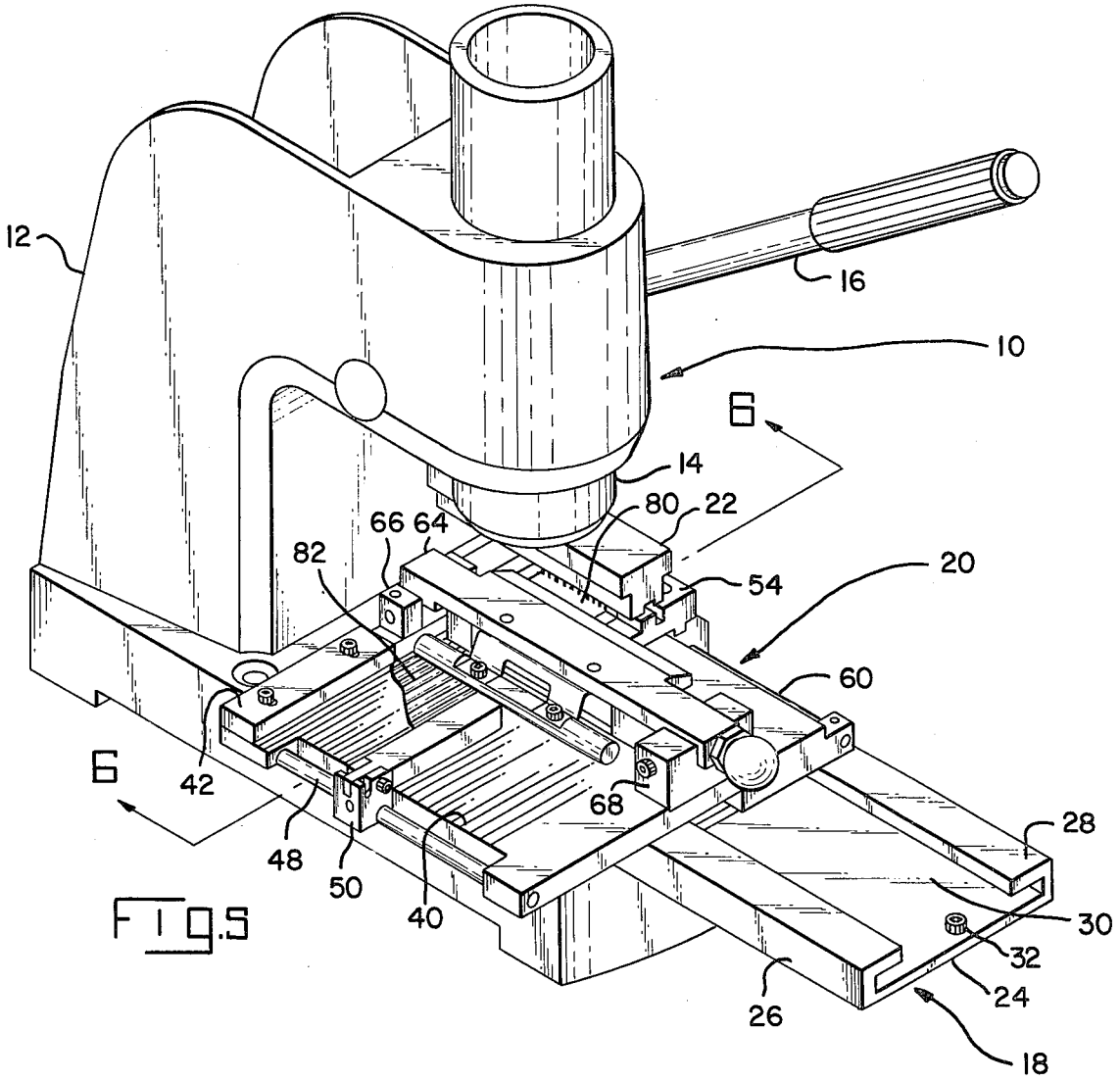
FIG. 5 is a perspective view similar to FIG. 1 showing the applicator tool positioned ready to apply a connector to a multi-conductor flat flexible cable.

The entire electrical connector applicator tool according to the present invention is shown in FIGS. 1 and 5. The subject applicator tool 10 includes a substantially C-shaped frame 12, an applicator ram 14 mounted for vertical movement in the upper portion of the frame, ram actuation means 16, guide rail means 18 fixed to the lower portion of the frame, and a base plate assembly 20 slidably mounted on the guide rail means 18. The frame 12 has been shown in a non-limiting configuration suitable for bench mounting of the subject tool. Clearly other suitable shaped frames could be substituted for the one shown. The ram actuating means 16 has been shown as a lever which would actuate a conventional rack and pinion or other suitable gearing (not shown) to drive the ram 14. The actuation means shown could be replaced by any suitable power drive means, such as a fluid actuated motor, without departing from the scope of the subject invention. An upper tool member 22 is detachably mounted on the lower end of the ram 14 and is profiled and dimensioned according to the product to be assembled.

Figure 6:
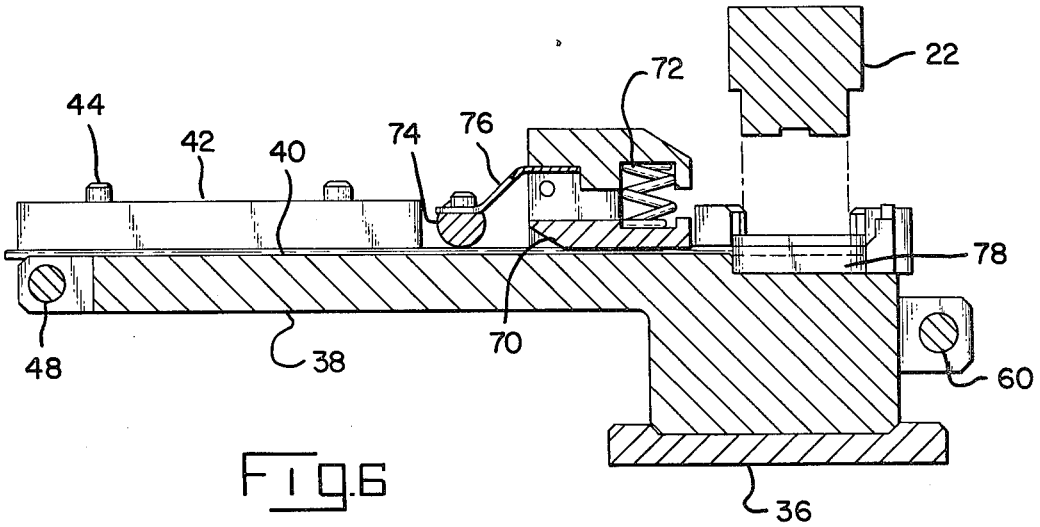
FIG. 6 is a vertical section through the base plate assembly taken along line 6—6 of FIG. 5.

The guide rail assembly 18 includes a base plate 24 and a pair of integral side rails 26, 28 on opposite sides of the plate 24 in parallel spaced fashion defining a guide channel 30 therebetween. Front and rear ends stops 32, 34 respectively, are detachably secured in the channel 30 to limit the movement of base plate assembly 20 therein. The base plate assembly 20 includes a sliding base member 36 (FIG. 6) which is mounted for sliding movement in the channel 30 between a position displaced from beneath the ram 14 and tool member 22, as shown in FIG. 1, and a position immediately beneath the ram 14 and tool member 22, as shown in FIG. 5.

Figure 2:
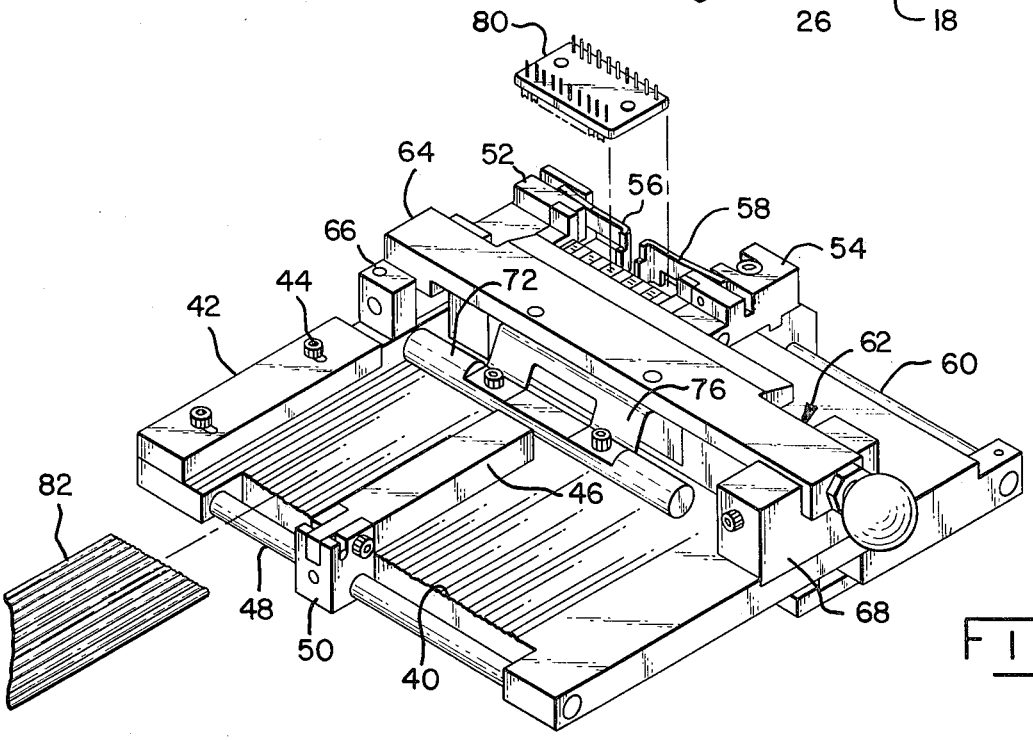
FIG. 2 is a perspective view of the details of the base plate assembly of the applicator tool showing a cable and a connector exploded therefrom.

The base plate assembly 20 includes a fluted base plate 38 secured to the sliding base member 36. Flutes 40 extend along the cable receiving face normal to the direction of sliding movement of the assembly. A first cable guide 42 is secured to a first side of the base plate 38 by fastener means 44 and a moveable cable guide 46 is attached to the base plate 38 by a fixed rail 48 which extends normal to the direction of the flutes 40. The moveable cable guide includes an assembly 50 which holds the moveable cable guide 46 parallel to the fixed guide 42. The base plate assembly 20 also includes the first cable stop 52 and a second cable stop 54. Each cable stop has a pivotal abutment member 56, 58 and the second cable stop 54 is adjustable with respect to the first cable stop 52 to adjust for the width of the cable. The second cable stop 54 is movable along a horizontal fixed rail 60 in the manner of the assembly 50 and rail 48. The cable clamp assembly 62 includes an elongated arm 64, one end of which is pivoted to a frame 66 which in turn is fixed on one side of the base plate 38. A locking mechanism 68 is fixed on the other side of the base plate 38 and receives the free end of the arm 64. A pressure plate 70 is mounted on the underside of the arm 62 by means of springs 72 (FIG. 6) and held is in parallel spaced relationship therefrom. The springs are biased such that when the arm 64 is in the closed position, shown in FIG. 2, the pressure plate 70 will secure a cable tightly against the fluted surface of the base plate 38. The clamping mechanism further includes a bar 74 held by spring member 76 to depend from the arm 64 in such manner as to initially engage a cable on the fluted surface and hold it against unintended extraction. The base plate 38 also has a cover receiving recess 78 which extends normal to the direction of the flutes 40.

Figure 3:
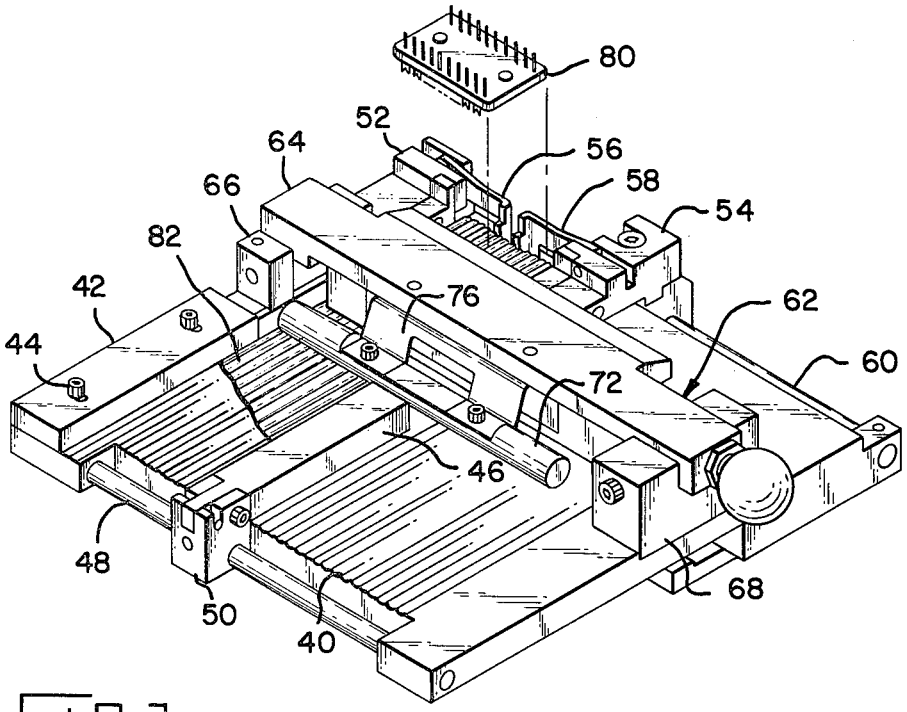
FIG. 3 is a view similar to FIG. 2 showing the cable in place but the connector still exploded from the base plate assembly.
Figure 4:
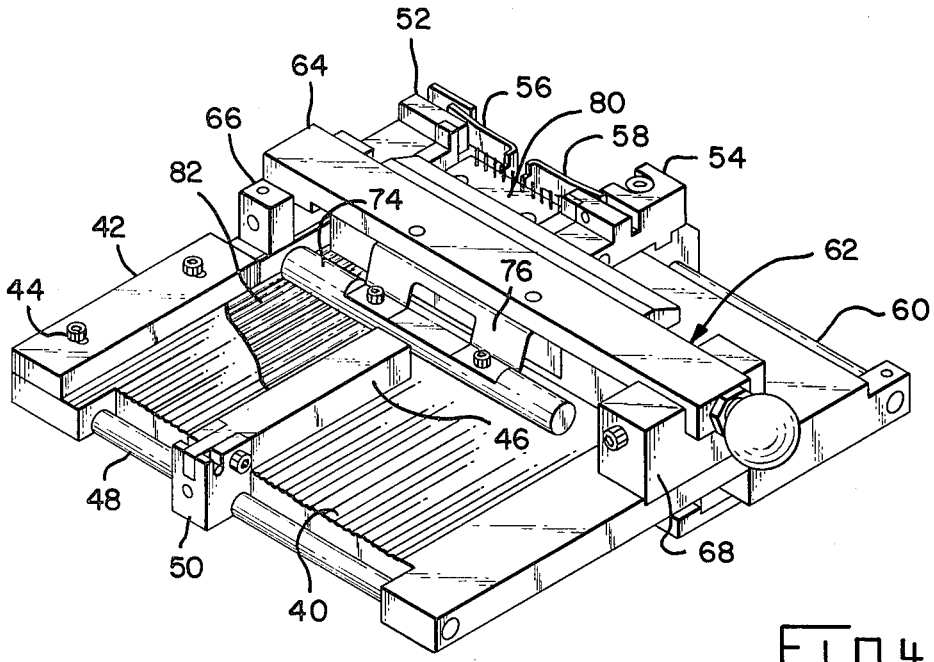
FIG. 4 is a view similar to FIGS. 2 and 3 showing the base plate assembly conditioned ready to apply the connector to the cable.

In order to apply a connector 80 to a multi-conductor flat cable 82 with the subject applicator tool, it is first necessary to determine what size of connector is to be applied and the configuration of the contacts in the connector. A typical connector of the type applied by this tool is shown in U.S. Pat. No. 3,820,055 as mentioned above. The applicable upper tool member 22 is first mounted at the lower end of the ram 14 with the proper alignment with respect to the base plate assembly 20 when in position for insertion (FIG. 5). It also must be determined what type of cable is to be used, namely whether it will be pre-formed cable and the number of conductors in the cable. The appropriate base plate assembly 20 is placed in the channel 30 and the cable guide 46 and end stop 54 are adjusted for proper positioning of the cable with respect to the terminating assembly. The base plate assembly 20 should be checked by sliding to position beneath the ram to see that the upper tool member is properly positioned with respect to the cover recess 78. When the tool has been adjusted for the proper cable 82 and connector 80, it is ready for use and may be used by first opening the cable clamp 62, positioning the cable 80 between the guides 42, 46 and against the abutments 56, 58. The cable is then secured against the base plate by placing the clamp 62 into the position shown in FIG. 3. Initially the bar 74 will lie against the cable to hold it in position while the final clamping action takes place. Because the base plate 38 is provided with flutes 40, each conductor of the cable will lie in an appropriate flute and will remain parallel with each other and with the cable guides. The conductors will also be aligned properly with the contacts of the connector 80 when the connector is placed in the tool 22. A cover member (not shown) is placed in the recess 78. The base plate assembly 20 is moved rearwardly until it abuts against the rear stop 34, as shown in FIG. 5. The ram is then positioned directly above the connector and is actuated until the connector is bottomed against the cable by the ram. This action causes the terminals of the connector to penetrate the insulation of the cable and effect interconnection with the conductors thereof.

Should it be desired to make a daisy chain of a plurality of connectors on a single cable, it is only necessary to pivot the abutments 56, 58 to clear the way for the cable 82 to be fed continuously through the tool while sequentially applying connectors 80. The cable clamp 62 would have to be loosened from engagement with the stop 68, but the clamp bar 74 would remain loosely against the cable to assure that it stays in the proper flutes of the plate.

The present invention may be subject to many modifications and changes without departing from the spirit or essential characteristics thereof. The present embodiment is therefore to be considered in all respects as illustrative and not restrictive of the scope of the invention.

What is claimed is:

1. In an applicator tool for applying a connector having a plurality of insulating piercing electrical terminals onto a multi-conductor flat cable with each terminal engaging a respective conductor, said tool having a frame having integral spaced upper and lower arms, ram means mounted in said upper arm for vertical movement, an upper tooling member mounted on a free lower end of said ram means, means to actuate said ram means, guide rail means mounted on said lower arm extending from a point beneath said ram means in cantilever fashion, and a lower tooling assembly including a sliding base mounted on said guide rail means for sliding motion between a point remote from said ram to said point beneath said ram, a base plate assembly fixed to said sliding base and including a base plate, cable guide means mounted on the base plate, cable clamp means for securing a cable to said base plate, connector receiving means, and cable stop means selectively positionable to abut the free end of a cable and to allow through feed of said cable whereby a connector can be applied intermediate the ends of the cable, said cable clamp means comprising:

a first fixture secured to one edge of said base plate, a locking fixture secured to the opposite edge of said base plate, a clamping arm having one end pivotally attached to said first fixture and locking means on the opposite free end engageable with said locking fixture, first cable engaging means supported on said clamping arm by first spring means so as to apply constant force to a cable, and second cable engaging means supported on said clamping arm by second spring means so as to apply increased force to a cable upon locking of said clamping arm in said locking feature.

2. An applicator tool according to claim 1 wherein said cable guide means comprises:

first cable guide means fixed along one side edge of said base plate, rod means secured at one end of said base plate extending normal to said first cable guide means, and second cable guide means mounted on said rod means for movement therealong in parallel spaced relationship with respect to said first cable guide means.

3. An applicator tool according to claim 1 wherein said cable stop means comprises:

a first stop fixture secured to said base plate along one end edge thereof, rail means extending along said end of said base plate, a second stop fixture slidably mounted on said rail means, each said stop fixture having an arm pivotally mounted thereon for movement between a first position blocking passage of a cable to a second position permitting passage of a cable between said fixtures.

4. An applicator tool according to claim 1 wherein said connector receiving means comprises:

a recess in said base plate profiled to receive at least a portion of a connector to be applied to said cable.

5. An applicator tool according to claim 1 wherein said base plate has a plurality of parallel flutes on its face extending in the direction of the conductors of a cable to be received thereby.

* * * * *